US005121725A

United States Patent [19]

Araki

[11] Patent Number: 5,121,725

[45] Date of Patent: Jun. 16, 1992

[54] SYSTEM AND METHOD FOR CONTROLLING ENGINE IDLING SPEED APPLICABLE TO INTERNAL COMBUSTION ENGINE

[75] Inventor: Akihiko Araki, Gumma Prefecture, Japan

[73] Assignee: Japan Electronic Control Systems Co., Ltd., Isezaki, Japan

[21] Appl. No.: 731,060

[22] Filed: Jul. 17, 1991

[51] Int. Cl.[5] ..... F02D 41/16

[52] U.S. Cl. ..... 123/339

[58] Field of Search ..... 123/339

[56] References Cited

U.S. PATENT DOCUMENTS 4,491,108 1/1985 Hasegawa et al. ..... 123/339
4,562,808 1/1986 Tominaga et al. ..... 123/339
4,862,851 9/1989 Washino et al. ..... 123/339
4,883,034 11/1989 Yashiki et al. ..... 123/339

FOREIGN PATENT DOCUMENTS 1-158537 11/1989 Japan .
2-161151 6/1990 Japan ..... 123/339

*Primary Examiner*—Andrew M. Dolinar
*Attorney, Agent, or Firm*—Foley & Lardner

[57] ABSTRACT

In a method and system for controlling an engine idling speed applicable to an internal combustion engine, a pulse duty ratio of a pulse signal supplied to an engine idling control valve is set by adding a basic control value, a proportional constant, and integration constant. The integration constant, set according to a difference between a target engine idling speed and an actual engine revolution speed, is modified as follows; during normal engine idling, the integration constant is set according to which one of the compared values of the target engine idling speed and actual engine revolution speed is greater. However, when an external load is applied to the engine, the integration constant is set by a quantity corresponding to the proportional constant.

9 Claims, 2 Drawing Sheets

SYSTEM AND METHOD FOR CONTROLLING ENGINE IDLING SPEED APPLICABLE TO INTERNAL COMBUSTION ENGINE

BACKGROUND OF THE INVENTION

1. Field of the Invention

The present invention relates to a system and method for controlling an engine idling speed applicable to an internal combustion engine in which the engine idling speed, at a time immediately after a disturbance (external load) occurs, is stabilized.

2. Description of the Background Art

A Japanese Utility Model Registration First Publication No. Heisei 1-158537 exemplifies a previously proposed engine idling speed control system.

In the above-identified Japanese Utility Model Registration First Publication, an idling control valve is installed in a bypass passage bypassing a throttle valve. The throttle valve serves to open and close an intake air passage of the engine.

The engine idling speed is thus controlled by adjusting the intake air quantity passing through the bypass passage by means of the idling control valve to which a pulse signal having a pulse duty factor (ratio) is supplied.

The pulse duty ratio is set according to a basic controlled value ISCT and a feedback correction value ISCI. The basic controlled value ISCT is set according to an engine coolant temperature. The feedback correction value includes a proportional constant ISCP and an integration constant ISCI.

Engine idling speed generally drops at high speeds when an relatively large external load is imposed, such as when a powered steering system, defogger, or air conditioner is operated.

If the drop in the engine idling speed is corrected via feedback control, hunting of the engine revolution speed occurs.

That is to say, since an increase rate of the integration constant ISCI is slow, the proportional constant ISCP fluctuates until the integration constant ISCI is settled to an appropriate value after the external load is added. Thus, hunting of the engine revolution speed N occurs.

SUMMARY OF THE INVENTION

It is therefore an object of the present invention to provide an engine idling speed control system and method in which hunting of engine revolution speed is avoided, even if an abrupt addition of external load to the engine occurs during engine idling.

The above-described object can be achieved by providing a system for controlling an engine idling speed for an internal combustion engine, comprising: a) control valve means which is driven in response to a pulse signal having a variable pulse duty ratio so as to open and close a bypass passage bypassing a throttle valve, the throttle valve being installed in an intake air passage so as to open and close the intake air passage in response to accelerator operation; b) engine temperature detecting means for detecting an engine temperature; c) target engine idling speed setting means for setting a target idling speed according to the engine temperature; d) engine revolution speed detecting means for detecting an actual engine revolution speed; e) engine revolution speed comparing means for comparing the target idling speed with the actual engine revolution speed; f) proportional constant setting means for setting a proportional constant of a feedback correction coefficient of the engine idling speed according to a difference between the target idling speed and actual engine revolution speed; g) integration constant setting means for setting an integration constant of the feedback correction coefficient according to which one of the compared values is greater; h) controlled value setting means for adding the proportional constant, integration constant and basic controlled value so as to set a final controlled value of the pulse duty ratio; i) detecting means for detecting an external load applied to the engine; and j) integration constant correcting means for correcting the integration constant by a quantity according to the proportional constant within a predetermined interval of time upon generation of the external load.

The above-described object can also be achieved by providing a method for controlling engine idling speed for an internal combustion engine, the engine including control valve means which is driven in response to a pulse signal having a variable pulse duty ratio so as to open and close a bypass passage bypassing a throttle valve, the throttle valve being installed in an intake air passage so as to open and close the intake air passage in response to operation of an accelerator, the method comprising the steps of; a) detecting an engine temperature; b) setting a target idling speed according to the engine temperature; c) detecting an actual engine revolution speed; d) comparing the target idling speed with the actual engine revolution speed; e) setting a proportional constant of a feedback correction coefficient of the engine idling speed according to a difference between the target idling speed and actual engine revolution speed; f) setting an integration constant of the feedback correction coefficient according to which one of the compared values is greater; g) adding the proportional constant, integration constant and basic controlled value so as to set a final controlled value of the pulse duty ratio; h) detecting an external load applied to the engine; and i) correcting the integration constant by a quantity according to the proportional constant within a predetermined interval of time upon generation of the external load.

DETAILED DESCRIPTION OF THE PREFERRED EMBODIMENT

Reference will hereinafter be made to the drawings in order to facilitate a better understanding of the present invention.

Figure 1:
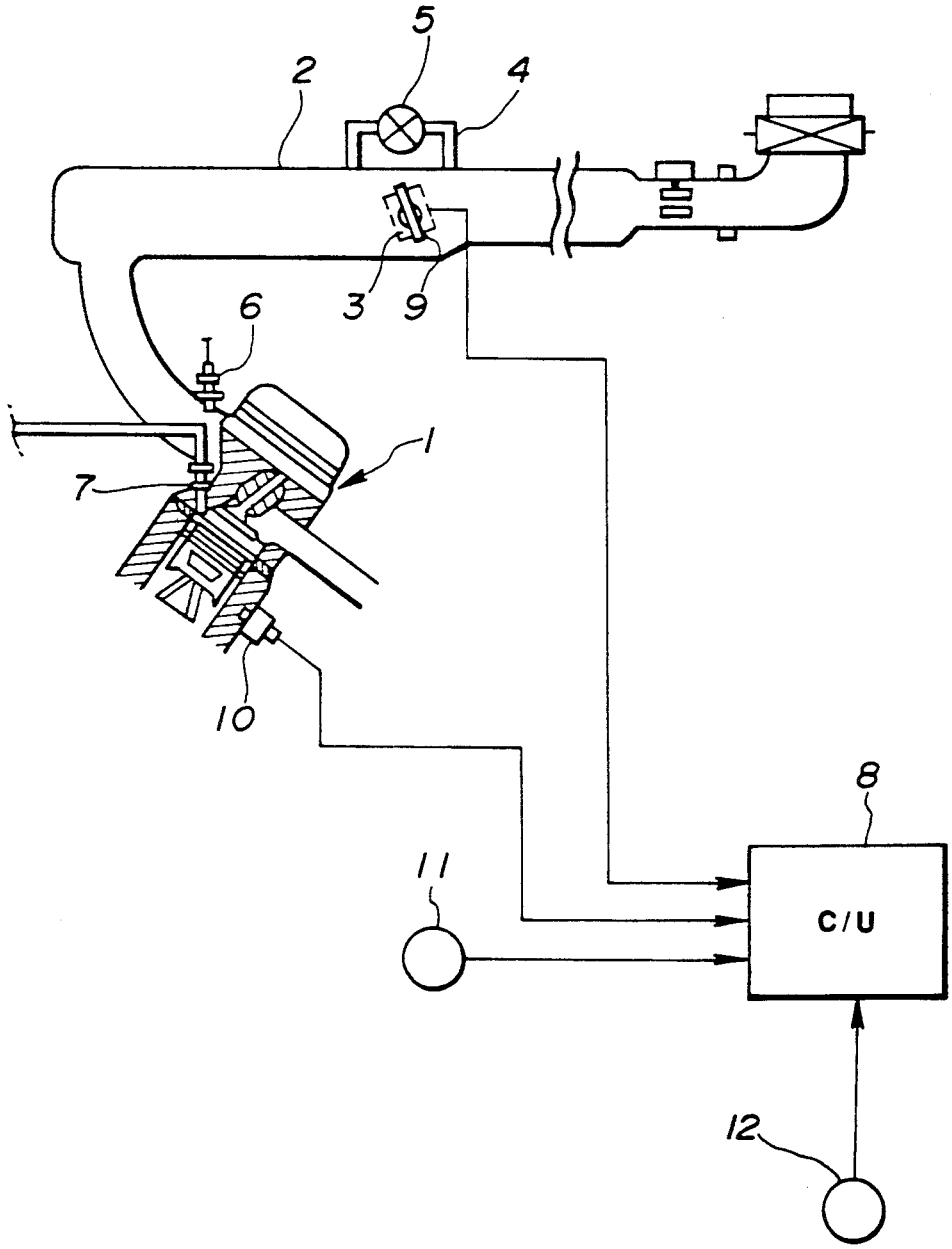
FIG. 1 is a schematic diagram of an engine idling speed control system applicable to an internal combustion engine in a preferred embodiment according to the present invention.

FIG. 1 shows a preferred embodiment of an engine idling speed control system according to the present invention.

In FIG. 1, an engine 1 is provided with an intake air passage 2 through which intake air is supplied to the engine 1. A throttle valve 3 is installed to open and close the intake air passage 2 in response to an accelerator pedal (not shown). An idling control valve 5 is installed in a bypass passage 4 which bypasses the throttle valve 3. The idling control valve 5 serves to open and close the bypass passage 4 in response to a pulse signal having a pulse duty ratio.

The engine 1 receives an injected fuel through an injection valve 6 and an air mixture fuel is ignited by means of a spark plug 7 installed in each of the engine cylinders.

A control unit 8, including a microcomputer, receives signals derived from an idling switch 9 which is turned on when the throttle valve 3 is fully closed, a water temperature sensor 10 for detecting a coolant temperature of the engine 1, and a switch 12 for switching on operation of an external load such as an air conditioner, etc.

Figure 2:
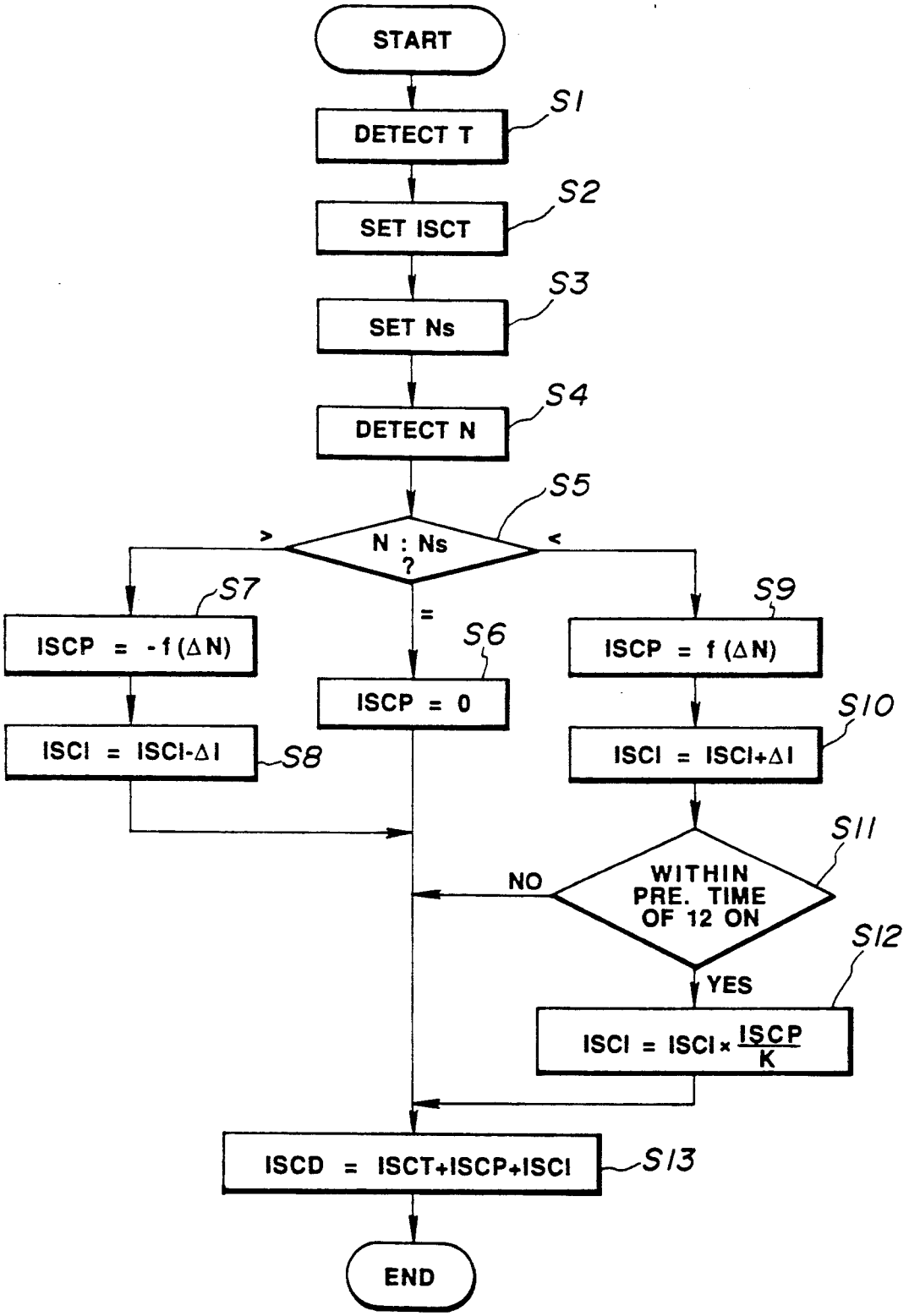
FIG. 2 is an operational flowchart of the engine idling speed control system shown in FIG. 1.

FIG. 2 shows an operational flowchart executed by the control unit 8.

FIG. 2 is a program flowchart of an engine idling speed control routine.

In a step S1, the control unit 8 retrieves the signal derived from the water temperature sensor 10 to input the value of the coolant temperature T.

In a step S2, the control unit 8 sets the basic controlled value ISCT by referring to a map of pulse duty ratios prepared on the basis of the coolant temperature T.

In a step S3, the control unit 8 sets a target idling speed Ns by referring to a map prepared on the basis of the engine coolant temperature T.

In a step S4, the control unit 8 detects an actual engine revolution speed from an engine revolution speed sensor 11.

In a step S5, the control unit 8 compares the engine revolution speed N with the target idling speed Ns.

If N=Ns, the routine goes to a step S6 in which a proportional constant ISCP of a feedback correction coefficient is set to zero and goes to a step S13. It is noted that the integration constant ISCI remains the same value as the previous value.

If N>Ns, the routine goes to step S7 in which the proportional constant ISCP is set according to the following equation.

$$ISCP = -f(\Delta N);$$

$$\Delta N = |N - Ns|$$

wherein f denotes a predetermined function.

In a step S8, the integration constant ISCI is set according to the following equation.

$$ISCI = ISCI - \Delta I$$

wherein ΔI denotes a minute predetermined value.

Thereafter, the routine goes to a step S13.

If N<Ns, the routine goes to a step S9 in which the proportional constant ISCP is set according to the following equation.

$$ISCP = f(\Delta N)$$

In a step S10, the integration constant ISCI is set according to the following equation.

$$ISCI = ISCI + \Delta I$$

In a step S11, the control unit 8 determines whether the present time is within a predetermined interval of time upon an switching on of the external load switch 12. If No in the step S11, the routine goes to a step S13. On the other hand, if YES, the routine goes to a step S12.

In the step S12, the control unit 8 calculates the following equation:

$$ISCI = ISCI \times ISCP/K.$$

wherein K denotes a predetermined value.

When the above-expressed calculation is carried out, a final controlled value ISCD is quickly obtained with the external load added to the engine, the final controlled value being able to maintain a stable target idling speed.

In the step S13, the final controlled value ISCD is set according to the following equation and the routine is ended.

$$ISCD = ISCT + ISCP + ISCI$$

The pulse signal having the pulse duty ratio determined from the final controlled value ISCD is output to the idling control valve 5. The idling speed is controlled by means of the idling control valve 5 whose opening angle is adjusted according to the pulse duty ratio.

It is noted that the step S1 corresponds to engine temperature detecting means, the step S2 corresponds to basic controlled value setting means, the step S3 corresponds to engine revolution speed detecting means, the step S5 corresponds to engine revolution speed comparing means, the steps S8 and S10 correspond to integration constant setting means, the steps S11 correspond to external load detecting means, the step S12 corresponds to the integration constant correcting means, and the step S13 corresponds to the final controlled value setting means.

As described hereinabove, in the method and system for controlling engine idling speed according to the present invention, the integration constant is corrected to a larger value than usual so as to quickly eliminate abrupt drop of the engine revolution speed due to the addition of the external load onto the engine when the present time is within the predetermined interval of time from generation of the external load. Consequently, a time duration for which the hunting of the engine revolution speed occurs can be made as short as possible. In addition, engine driveability is improved.

It will fully be appreciated by those skilled in the art that the foregoing description has been made in terms of the preferred embodiment and various changes and modifications may be made without departing from the scope of the present invention which is to be defined by the appended claims.

What is claimed is:

1. A system for controlling an engine idling speed for an internal combustion engine, comprising:

a) control valve means which is driven in response to a pulse signal having a variable pulse duty ratio so as to open and close a bypass passage bypassing a throttle valve, the throttle valve being installed in an intake air passage so as to open and close the intake air passage in response to accelerator operation:

b) engine temperature detecting means for detecting an engine temperature;

c) target engine idling speed setting means for setting a target idling speed according to the engine temperature;

d) engine revolution speed detecting means for detecting an actual engine revolution speed;
e) engine revolution speed comparing means for comparing the target idling speed with the actual engine revolution speed;
f) proportional constant setting means for setting a proportional constant of a feedback correction coefficient of the engine idling speed according to a difference between the target idling speed and actual engine revolution speed;
g) integration constant setting means for setting an integration constant of the feedback correction coefficient according to which one of the compared values is greater;
h) controlled value setting means for adding the proportional constant, integration constant and basic controlled value so as to set a final controlled value of the pulse duty ratio;
i) detecting means for detecting an external load applied to the engine; and
j) integration constant correcting means for correcting the integration constant by a quantity according to the proportional constant within a predetermined interval of time upon generation of the external load.

2. A system as set forth in claim 1, wherein the external load is an air conditioner mounted in a vehicle in which the engine is mounted and the external load switch is a switch which is turned on to operate the air conditioner.

3. A system as set forth in claim 2, wherein the proportional constant setting means sets the proportional constant (ISCP) in the following way when the compared result of the actual engine revolution speed and target engine idling speed is N>Ns:

$$ISCP = -f(\Delta N);$$

$$\Delta N = |N - Ns|,$$

wherein N denotes the actual engine revolution speed, Ns denotes the target engine revolution speed, and f denotes a predetermined function and sets the proportional constant ISCP in the following way when the compared result thereof is N>Ns:

$$ISCP = f(\Delta N).$$

4. A system as set forth in claim 3, wherein the integration constant setting means sets the integration constant ISCI in the following way when N>Ns:

$$ISCI = ISCI - \Delta I$$

wherein ΔI denotes a minute predetermined value, and sets the integration constant ISCI in the following way when N<Ns:

$$ISCI = ISCI + \Delta I.$$

5. A system as set forth in claim 4, wherein the integration constant setting means sets the integration constant ISCI in the following way when the present time is within the predetermined interval of time from a switching ON of the air conditioner;

$$ISCI = ISCI \times ISCP/K.$$

wherein K denotes a predetermined value.

6. A system as set forth in claim 5, wherein the final controlled value is calculated as follows:

$$ISCD = ISCT + ISCP + ISCI.$$

wherein ISCT denotes the basic controlled value.

7. A system as set forth in claim 6, wherein said engine temperature detecting means comprises an engine coolant temperature sensor.

8. A system as set forth in claim 7, wherein the control valve means comprises an engine idling control valve which is installed in the bypass passage for controlling an intake air quantity passing through the bypass passage according to an opening angle thereof, the opening angle being dependent on the variable pulse duty ratio of the pulse signal supplied to the engine idling control valve.

9. A method for controlling engine idling speed for an internal combustion engine, the engine including control valve means which is driven in response to a pulse signal having a variable pulse duty ratio so as to open and close a bypass passage bypassing a throttle valve, the throttle valve being installed in an intake air passage so as to open and close the intake air passage in response to accelerator operation, the method comprising the steps of:

a) detecting an engine temperature;
b) setting a target idling speed according to the engine temperature;
c) detecting an actual engine revolution speed;
d) comparing the target idling speed with the actual engine revolution speed;
e) setting a proportional constant of a feedback correction coefficient of the engine idling speed according to a difference between the target idling speed and actual engine revolution speed;
f) setting an integration constant of the feedback correction coefficient according to which one of the compared values is greater;
g) adding the proportional constant, integration constant and basic controlled value so as to set a final controlled value of the pulse duty ratio;
h) detecting an external load applied to the engine; and
i) correcting the integration constant by a quantity according to the proportional constant within a predetermined interval of time upon generation of the external load.

* * * * *

UNITED STATES PATENT AND TRADEMARK OFFICE

CERTIFICATE OF CORRECTION

PATENT NO. : 5,121,725

DATED : Jun. 16, 1992

INVENTOR(S) : Akihiko ARAKI

It is certified that error appears in the above-identified patent and that said Letters Patent is hereby corrected as shown below:

On the title page, after item [22], insert

[30] FOREIGN APPLICATION PRIORITY DATA

Jul. 18, 1990 [JP] Japan.....2-75545

Signed and Sealed this

Twelfth Day of October, 1993

Bruce Lehman

*Attest:*

BRUCE LEHMAN

*Attesting Officer*

*Commissioner of Patents and Trademarks*